US010000269B2

(12) United States Patent
Burk et al.

(10) Patent No.: US 10,000,269 B2
(45) Date of Patent: Jun. 19, 2018

(54) COLUMN BASED ELECTRIC ASSIST MARINE POWER STEERING

(71) Applicant: STEERING SOLUTIONS IP HOLDING CORPORATION, Saginaw, MI (US)

(72) Inventors: Matt R. Burk, Bay City, MI (US); Nick R. Alpers, Saginaw, MI (US); Addney T. Biery, II, Clio, MI (US); Brian G. Maust, Unionville, MI (US); John E. Weber, Pinconning, MI (US)

(73) Assignee: STEERING SOLUTIONS IP HOLDING CORPORATION, Saginaw, MI (US)

( * ) Notice: Subject to any disclaimer, the term of this patent is extended or adjusted under 35 U.S.C. 154(b) by 0 days. days.

(21) Appl. No.: 15/497,801

(22) Filed: Apr. 26, 2017

(65) Prior Publication Data

US 2017/0283027 A1 Oct. 5, 2017

Related U.S. Application Data

(63) Continuation of application No. 15/221,246, filed on Jul. 27, 2016, now abandoned.

(60) Provisional application No. 62/197,773, filed on Jul. 28, 2015.

(51) Int. Cl.
*B63H 25/24* (2006.01)
*B63H 25/04* (2006.01)

(52) U.S. Cl.
CPC ..... *B63H 25/24* (2013.01); *B63H 2025/045* (2013.01)

(58) Field of Classification Search
None
See application file for complete search history.

(56) References Cited

U.S. PATENT DOCUMENTS 4,120,258 A * 10/1978 Spurgin ..... B63H 25/08 114/144 E
4,366,768 A * 1/1983 Kulischenko ..... B62D 15/02 114/144 E
5,107,424 A * 4/1992 Bird ..... G05D 1/0206 114/144 RE
5,244,426 A * 9/1993 Miyashita ..... B63H 21/265 114/144 R
6,311,634 B1 * 11/2001 Ford ..... B63H 25/04 114/144 R
6,431,928 B1 * 8/2002 Aarnivuo ..... B63H 5/125 114/144 RE
6,715,438 B1 * 4/2004 Hundertmark ..... B63H 20/12 114/144 R (Continued)

*Primary Examiner* — Jonathan M Dager
(74) *Attorney, Agent, or Firm* — Cantor Colburn LLP

(57) ABSTRACT

An embodiment of a system for controlling a marine vessel includes an electrical power steering unit coupled to a mechanical control system, the mechanical control system including a steering wheel connected by a shaft to a mechanical cable assembly, the mechanical cable assembly configured to be actuated by the steering wheel to control a steering mechanism of the marine vessel. The electrical power steering unit includes an electric motor configured to apply a torque to the mechanical cable assembly. The system also includes a processor configured to control the electrical power steering unit to provide at least one of steering assist and control of the marine vessel.

20 Claims, 6 Drawing Sheets

(56) References Cited

U.S. PATENT DOCUMENTS 6,892,662 B2 * 5/2005 Watanabe ..... B63H 20/12 114/144 R
7,097,520 B2 * 8/2006 Okumura ..... B63H 20/12 114/144 R
7,137,347 B2 * 11/2006 Wong ..... B63H 25/24 114/144 RE
8,007,330 B2 * 8/2011 Wong ..... B63H 20/12 440/61 S
8,176,865 B2 * 5/2012 Zanfei ..... B63H 25/24 114/144 RE
8,255,102 B2 * 8/2012 Zanfei ..... B63H 25/02 114/144 R
9,389,634 B2 * 7/2016 Washino ..... B63H 25/02
2003/0033969 A1 * 2/2003 Doetsch ..... B63H 25/12 114/150
2004/0139903 A1 * 7/2004 Watabe ..... B63H 20/12 114/144 R
2005/0282448 A1 * 12/2005 Tawa ..... B63H 20/12 440/61 S
2006/0042532 A1 * 3/2006 Wong ..... B63H 25/02 114/144 RE
2006/0278152 A1 * 12/2006 Nickerson ..... B63H 25/14 114/144 R
2007/0066156 A1 * 3/2007 Mizutani ..... B63H 20/12 440/59
2007/0089661 A1 * 4/2007 Yazaki ..... B63H 20/12 114/144 RE
2007/0197110 A1 * 8/2007 Takada ..... B63H 20/12 440/53
2008/0108256 A1 * 5/2008 Mizutani ..... B63H 20/12 440/1
2008/0119094 A1 * 5/2008 Mizutani ..... B63H 20/12 440/53
2008/0119974 A1 * 5/2008 Mizutani ..... B63H 20/12 701/21
2008/0125925 A1 * 5/2008 Mizutani ..... B63H 20/12 701/21
2008/0200080 A1 * 8/2008 Mizutani ..... B63H 20/12 440/59
2009/0075533 A1 * 3/2009 Mizutani ..... B63H 20/12 440/6
2010/0114412 A1 * 5/2010 Mizutani ..... B63H 20/12 701/21
2011/0114004 A1 * 5/2011 Hundertmark ..... B63H 20/12 114/144 R
2011/0117798 A1 * 5/2011 Harada ..... B63H 20/12 440/58
2011/0117799 A1 * 5/2011 Harada ..... B63H 25/20 440/58
2012/0045951 A1 * 2/2012 Washino ..... B63H 20/12 440/63
2012/0143408 A1 * 6/2012 Hosokawa ..... B63H 25/04 701/21
2017/0029084 A1 * 2/2017 Burk ..... B63H 25/14
2017/0029085 A1 * 2/2017 Burk ..... B63H 25/24
2017/0106960 A1 * 4/2017 Weber ..... B63H 20/12
2017/0106961 A1 * 4/2017 Weber ..... B63H 25/42
2017/0106962 A1 * 4/2017 Weber ..... B63H 25/42

* cited by examiner

COLUMN BASED ELECTRIC ASSIST MARINE POWER STEERING

CROSS REFERENCE TO RELATED APPLICATIONS

This application is a continuation-in-part of U.S. patent application Ser. No. 15/221,246, filed Jul. 27, 2016, which claims the benefit to U.S. Provisional Application Ser. No. 62/197,773 filed Jul. 28, 2015, the entire disclosures of which are incorporated herein by reference in their entirety.

BACKGROUND OF THE INVENTION

Embodiments described herein relate to electrical power steering assist and control for marine applications. Embodiments described herein also relate to global positioning system (GPS) enabled control and speed-sensitive assist for marine applications.

Current marine vessel steering systems include hydraulic powered assist systems and mechanical flex-cable driven non-power assisted system. Mechanical systems are used on smaller and lower cost marine vessels (vessels having a length that is typically 18-22 feet or less), where assist is not considered essential and the application of a hydraulic powered steering system can be cost-prohibitive.

SUMMARY OF THE INVENTION

An embodiment of a system for controlling a marine vessel includes an electrical power steering unit coupled to a mechanical control system, the mechanical control system including a steering wheel connected by a shaft to a mechanical cable assembly, the mechanical cable assembly configured to be actuated by the steering wheel to control a steering mechanism of the marine vessel. The electrical power steering unit includes an electric motor configured to apply a torque to the mechanical cable assembly. The system also includes a processor configured to control the electrical power steering unit to provide at least one of steering assist and control of the marine vessel.

An embodiment of a method of controlling a marine vessel includes receiving sensor data from a sensor at a processor, the sensor data including at least one of a rotational position of a steering wheel and a torque applied by the steering wheel, the steering wheel connected by a shaft to a mechanical cable assembly, the mechanical cable assembly configured to be actuated by the steering wheel to control a steering mechanism of the marine vessel. The method also includes generating a motor torque command to an electrical power steering unit coupled to at least the mechanical cable, the electrical power steering unit including an electric motor configured to apply a torque to the mechanical cable assembly, and providing at least one of steering assist and control of the marine vessel by the electric motor in response to the motor torque command.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
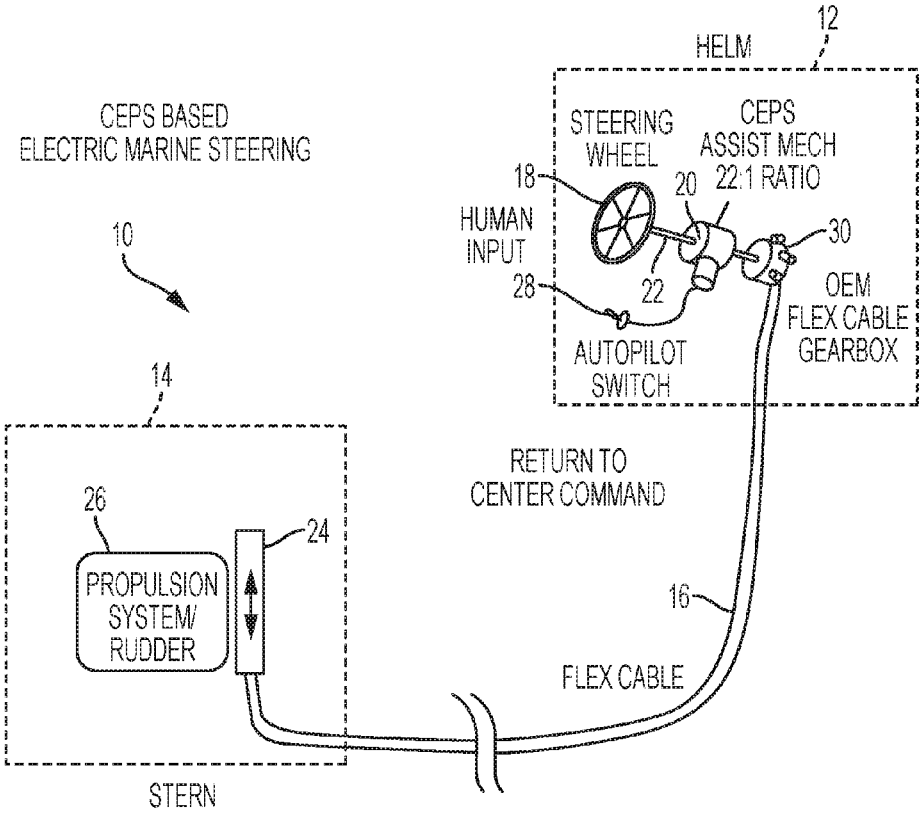
FIG. 1 depicts an embodiment of an electrical steering assist and/or control system for a marine vessel.

The following description is merely exemplary in nature and is not intended to limit the present disclosure, application, or uses. It should be understood that throughout the drawings, corresponding reference numerals indicate like or corresponding parts and features. The Figures are provided to describe various embodiments, without limiting same.

Systems and methods are provided for control of a mechanical steering system of a marine vessel. An embodiment of a control system for a marine vessel includes an electrical steering assist unit including an electric motor configured to apply torque to a steering wheel and/or mechanical steering cable. In one embodiment, the electrical steering assist unit is positioned at the shaft of a steering wheel or configured to connect to the shaft of the steering wheel to provide assist and/or control. The electrical steering assist unit may be configured to provide steering assist and/or direct control of the steering system.

Referring now to FIG. 1, an embodiment of a control system 10 of a marine vessel is illustrated. The control system 10 includes a mechanical steering system 12 connected to a propulsion system 14 by a mechanical cable 16 (e.g., a flex cable). Components of the steering system 12, which may be included at the helm region of the vessel (but can be included at any suitable location), include a steering wheel 18 connected to the cable 16, and an electrical steering assist unit 20 coupled to a steering shaft 22. Engaging the steering wheel 18 causes a mechanical actuator 24, such as a rack and pinion or a push-pull rod, to turn a rudder 26 (or other steering mechanism) on the stern of the marine vessel. The steering assist unit 20 is connected to a mechanical cable assembly that includes the cable 16 and a mechanical adapter to connect the steering assist unit 20 in operable relationship with the cable 16.

In one embodiment, the steering assist unit 20 is configured as a column electric power steering (CEPS) unit applied to a marine propulsion system. The steering assist unit 20 includes an electric motor as an actuator to provide assist to an operator in turning the steering wheel 18 and controlling the vessel. The steering assist unit 20 may also be configured as a semi-autonomous or autonomous steering unit that controls actuation of the cable without engagement of the steering wheel 18 by an operator. In some instances, the steering assist unit 20 can take over control of the vessel, e.g., in response to another system (e.g., a GPS or a proximity monitoring system), to respond to various conditions, such as an oncoming obstruction or other vessel. The steering assist unit 20 unit can switch to autonomous mode in response to various conditions, or in response to an instruction by an operator, for example, via an autopilot switch 28. The steering assist unit 20 unit can be connected directly to the cable 16 or connected via a gearbox 30.

Figure 2:
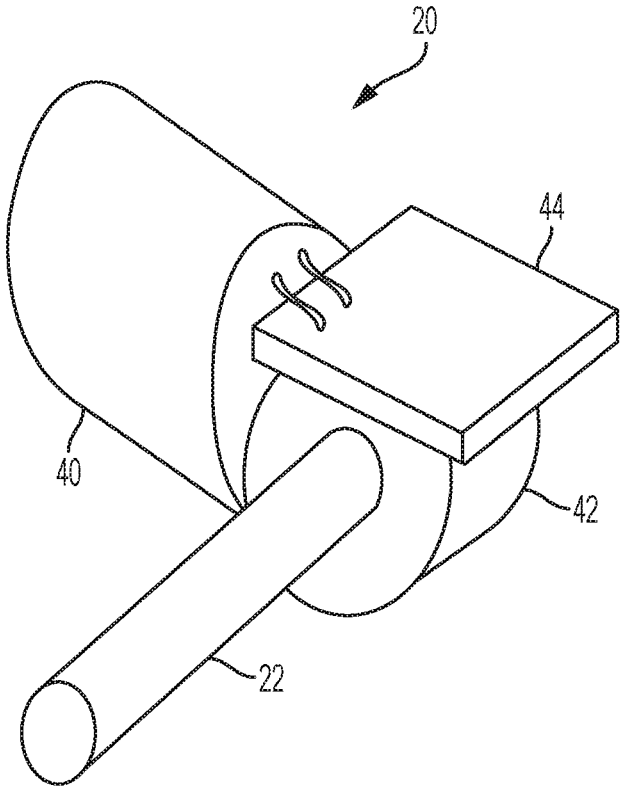
FIG. 2 depicts an embodiment of a column electric power steering (CEPS) unit for a marine vessel.

The steering assist unit 20, in one embodiment, is positioned between the steering wheel 18 and the gearbox 30 and/or cable 16. For example, the steering assist unit 20 may be installed on the original steering wheel shaft or positioned between the steering wheel shaft and the cable 16 and/or gearbox 30. FIG. 2 shows an example of a configuration of the steering assist unit 20. In this example, the steering assist unit 20 is configured as a CEPS unit that includes an electric motor 40 (e.g., a 12 volt direct current (DC) motor) that drives a gear mechanism 42 such as a worm gear right angle drive-assist mechanism. An onboard electronics unit 44 includes suitable circuitry and processing devices to control the motor 40 in response to instructions from an operator and/or in response to sensing devices such as an onboard torque sensor.

The steering assist unit 20 can be installed as original manufacturer equipment (OEM), or installed on pre-existing components without requiring substantial reconfiguration of the propulsion system.

In one embodiment, the steering assist unit 20 is physically fit within a marine steering column mounting area. The unit 20 may be powered with a power supply such as a marine 12 volt system located within the steering housing and/or helm.

For example, as shown in FIG. 2, the steering wheel shaft 22 can fit directly into an input shaft or adapter of the gear mechanism 42 or other suitable location on the steering assist unit 20. An output shaft or adapter opposite the input shaft is configured to couple directly to the cable 16, directly to the gear box 30 or to a connecting shaft coupled to the cable 16 and/or gearbox 30. The steering assist unit 20 (or components thereof) may be disposed in a housing having environmental protection based on the properties of the marine vessel system.

Figure 3:
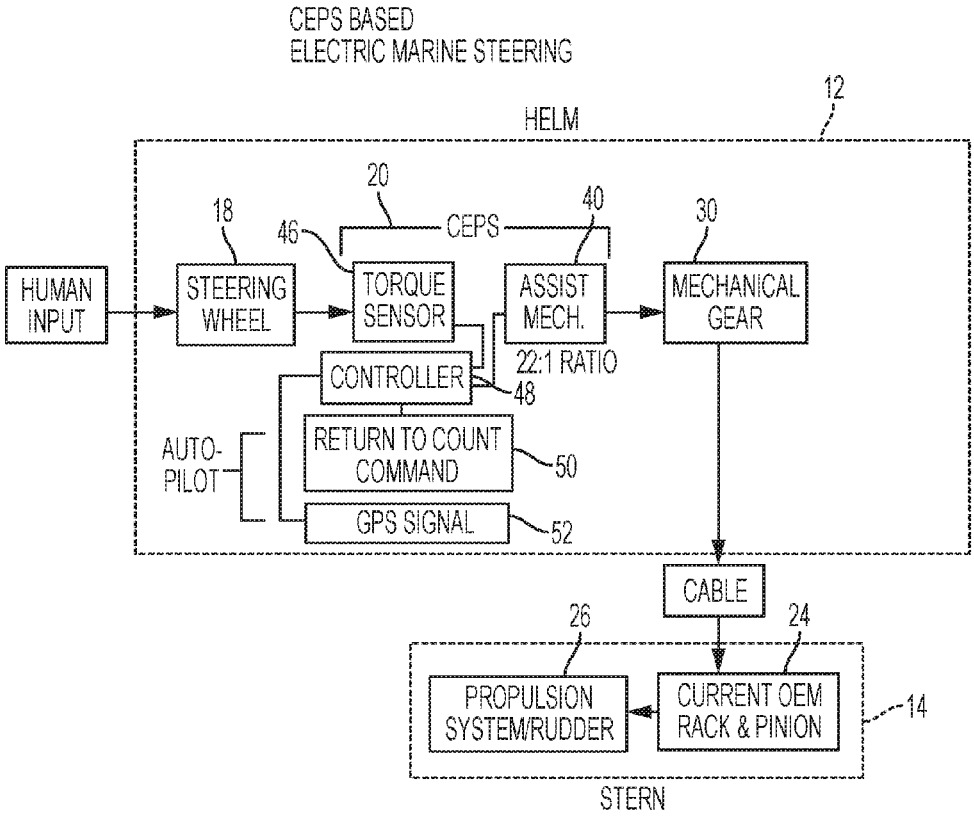
FIG. 3 shows a block diagram of communication flow of an electrical steering assist and/or control system.

FIG. 3 illustrates a block diagram of a command flow of the steering assist unit 20, which may be executed by a processing device (also referred to as a processor) according to suitable algorithms to affect various methods of controlling a marine vessel. The steering assist unit 20 includes a processing device located at any suitable location to allow the processing device to receive sensor data and generate motor commands. For example, the processing device is incorporated in the electronics unit 44.

In one embodiment, the steering assist unit 20 includes a torque sensor 46 in communication with a controller 48. The controller 48 is configured to control the motor 40 to provide steering assist and/or vessel steering control (autonomously or semi-autonomously).

In one embodiment, the steering assist unit 20 includes or is in communication with various control or processing modules such as a steering wheel position control module 50 and a location signal processing module 52. In one embodiment, the controller 48, the position control module 50 and/or the location signal processing module 52 are configured to control the vessel as part of an autopilot mode.

The steering assist unit 20 is configured to perform various vessel control and steering assist functions. The following descriptions illustrate various embodiments of a method of controlling aspects of a marine vehicle. It is noted that, although the embodiments are described in conjunction with the system 10 and steering assist unit 20, the embodiments are not so limited and may be performed in conjunction with any suitable processing device or system.

An embodiment of a method of controlling a marine vessel includes receiving a human input at the steering wheel, and measuring a rotational position and/or torque of the steering wheel via a position and/or torque sensor such as the torque sensor 46. Position and torque measurements may be performed by a combined position and torque sensor or by separate position sensor(s) and torque sensor(s). In one embodiment, the position and/or torque sensor includes an absolute position sensor. The position and/or torque sensor converts the mechanical signal provided by the steering wheel to a processor such as the controller 48, which generates a torque command to an electric motor such as the motor 40 to apply torque to assist the human operator in steering the vessel or to directly control vessel steering. The motor 40 and the controller 48 provide assistance in turning a mechanical gear, for example, which transmits torque to the cable 16 connected to the stern.

In one embodiment, the method includes receiving steering wheel position information and applying torque to the steering wheel 18 and/or mechanical gear 30. For example, the controller 48 is configured to receive position information from a sensor and identify the rotational center of the steering wheel 18. The position control module 50 (or other suitable processor) determines whether the steering wheel 18 is at center and whether the operator is applying a torque to the steering wheel. If no torque is being applied and the steering wheel is off center, the controller 48 and/or position control module 50 transmits a torque command to the motor 40 to apply a torque that causes the steering wheel 18 to rotate back to center.

In one embodiment, the method includes receiving steering wheel position information and applying torque to the steering wheel 18 and/or mechanical gear 30 to simulate an end stop and prevent the steering wheel 18 from being rotated to the wheel's mechanical end stop. For example, the controller 48 receives position information and determines the rotational position of the steering wheel 18 with respect to the mechanical end stop. The controller 48 may direct the motor 40 to apply a torque to dampen steering or restrict further rotation when the rotational position of the steering wheel 18 is within a selected angular distance from the mechanical end stop. The controller 48 may determine various steering or operational conditions and respond thereto by applying an appropriate torque. For example, the position and/or torque sensor can be used to monitor steering wheel vibrations and apply appropriate torque to dampen such vibrations.

The controller 48 or other processor may be configured to apply torque and/or steering control in response to various other conditions. In one embodiment, the electrical power steering system is configured to provide speed-dependent steering assist. A vehicle speed sensor is incorporated into the marine vessel and provides vessel speed measurements to the controller 48. Based on the speed of the vessel, the controller 48 applies a variable level of torque assist. For example, the controller 48 directs the motor 40 to increase an amount of torque assist as speed increases or exceeds one or more speed thresholds. In another example, as speed increases or exceeds one or more speed thresholds, the controller 48 directs the motor to reduce the amount of torque assist to reduce steering responsiveness or sensitivity to make steering safer at higher speeds. In a further example, as speed decreases or is below one or more speed thresholds, the controller 48 directs the motor to increase the amount of torque assist to, e.g., assist in tight space maneuvering like trailering, docking, etc.

The controller 48 may further be in communication with a geographic location system such as a GPS system, which may be utilized by the controller 48 to provide automated location guidance. In one embodiment, the controller 48 receives geographic location information and provides different levels of torque assist based on the geographic location of the vessel. For example, the controller 48 is configured to direct the electric motor 40 to provide higher levels of assist when the marine vessel is within a selected range of a shore or docking location, e.g., to provide additional assistance when tight maneuvers are needed.

Speed and/or geographic location dependent assist control can prove useful in various situations. For example, under low speeds in a docking maneuver, the operator may fight conditions such as wind and tight spaces that are of less concern when travelling at higher speeds and/or when further from the shore. Such assist control provides additional assistance for the operator, who may need to rapidly rotate the wheel many degrees of rotation, to reduce the potential for fatigue.

In addition to steering assist, the controller may be configured to provide autopilot capability that can be activated by the operator (e.g., via the autopilot switch 28) or made available in certain conditions. For example, the controller 48 is configured to allow a user to select autopilot at geographic locations that are a selected distance from shore or otherwise in areas conducive to higher speeds. In another example, the controller 48 is configured to allow a user to select autopilot at low speeds or when close to the shore, e.g., to allow the controller to autonomously perform docking maneuvers.

During operation of a marine cable driven steering system, an operator turns the helm, which pushes or pulls on a cable that is attached to the engine on a marine vessel. As the cable wears, the force required to turn the vessel increases. A steering assist and/or control system (e.g., including the electrical steering assist unit 20) can provide torque to assist an operator in steering the vessel so that the operator does not need to provide the additional force and does not notice the increase. The output torque generated by the steering assist unit 20 can be configured to increase as a function of cable wear.

As steering cables wear and stretch over time and after repeated steering, in one embodiment, the system is configured to monitor various conditions associated with cable wear. The system executes an algorithm for monitoring cycles associated with steering and determining when the cable has been excessively deformed and/or worn, and maintenance or replacement should be performed.

Figure 4:
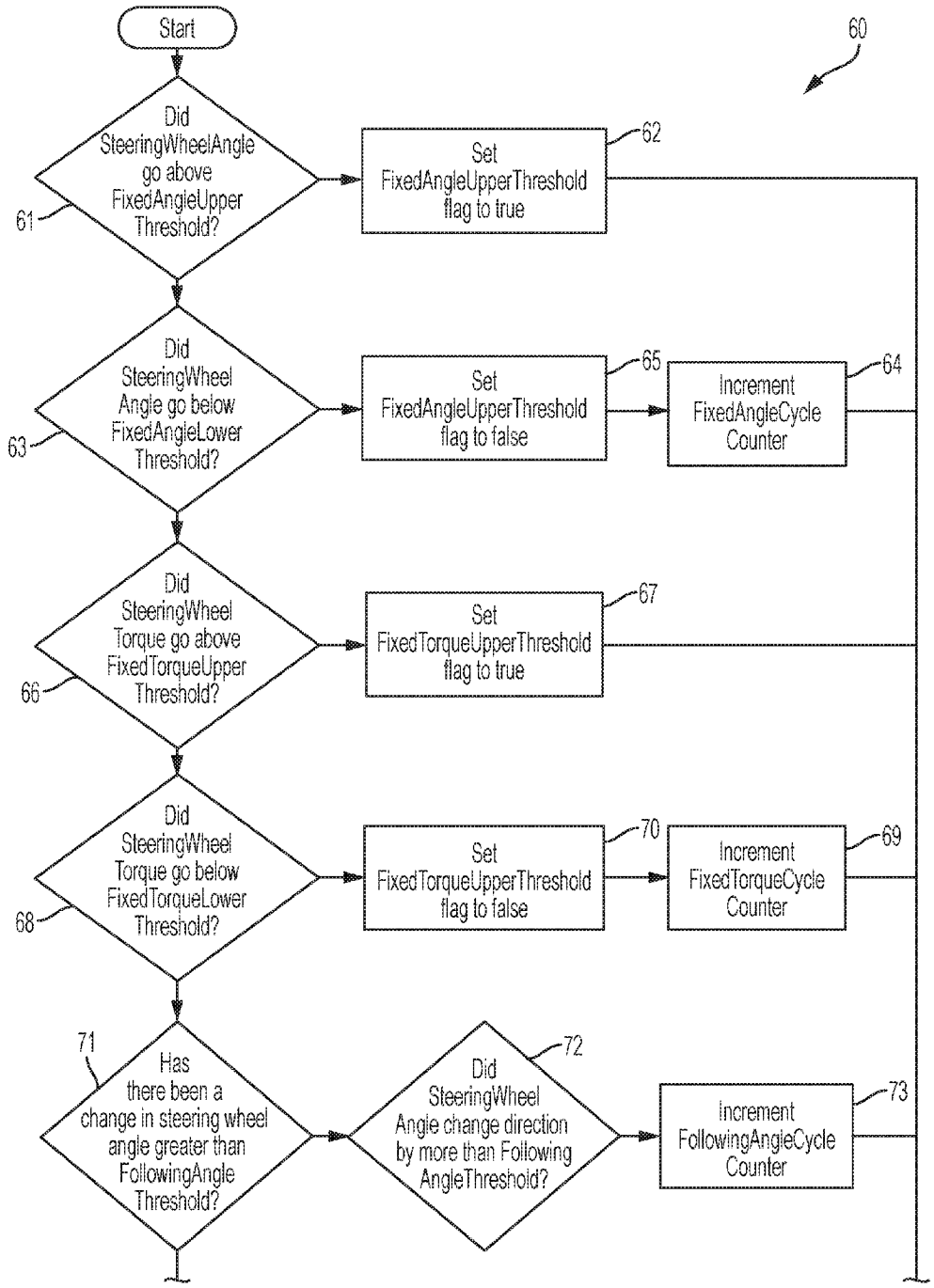
FIG. 4 is a flow diagram illustrating aspects of a method of controlling steering of a marine vessel, which includes monitoring conditions of the vessel and/or steering system that are associated with cable wear.
Figure 4:
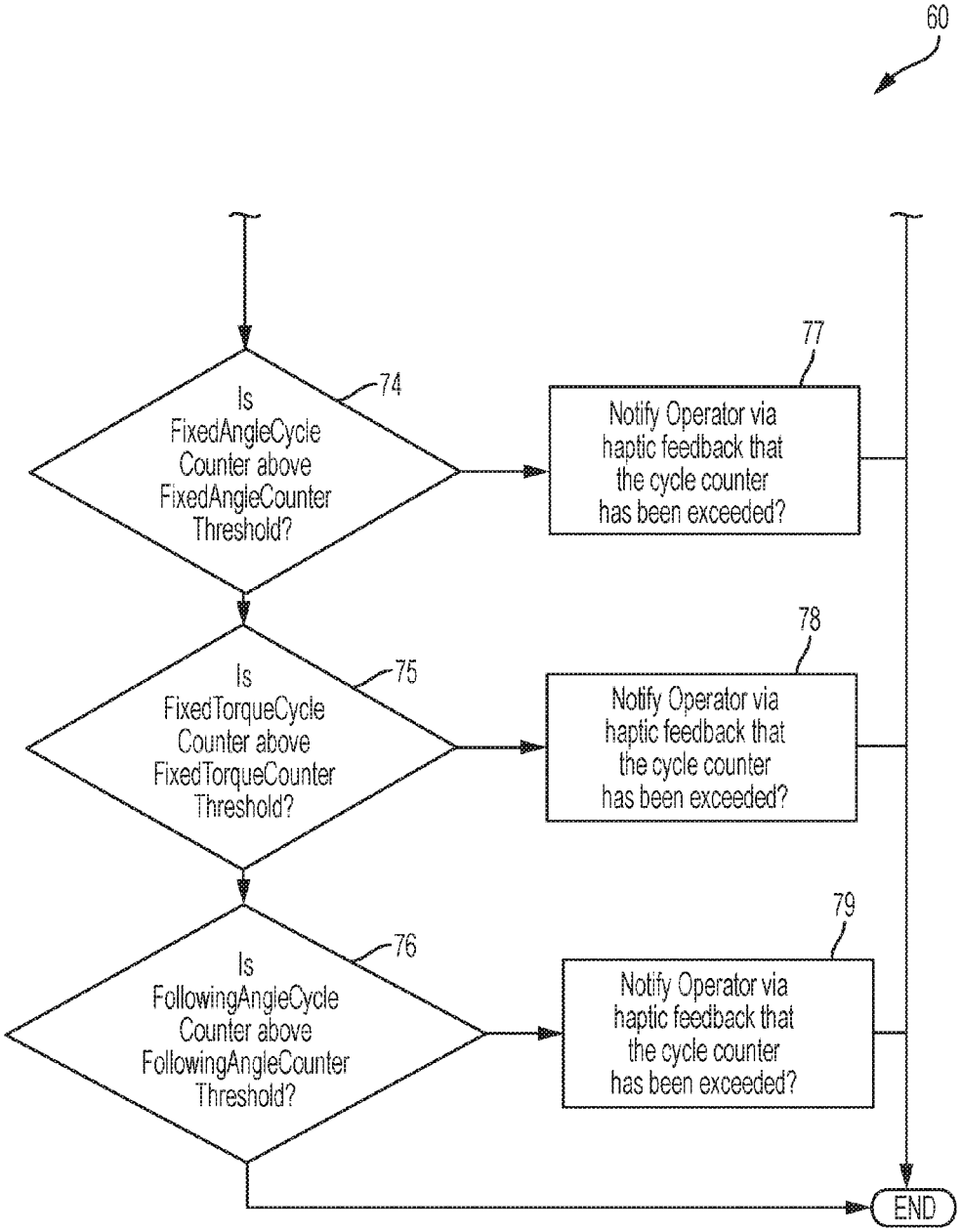

FIG. 4 depicts an embodiment of a method 60 for controlling aspects of a marine vehicle, which includes monitoring conditions of the vessel and/or steering system that are associated with cable wear. The method is based on counting various cycles that occur during operation of the steering system. The method tracks the number of cycles and determines whether excessive wear has occurred, a steering cable should be checked and/or the cable has reached the end of its service life.

The cycles include steering angle cycles and torque cycles that are based on the operator turning in one direction followed by turning in the opposite direction. The steering angle cycles include a steering wheel angle cycle and a following angle cycle. Each cycle is detected based on associated thresholds, which may be fixed, adjustable by an operator, or may be adjusted based on vehicle conditions. For example, the steering and/or torque thresholds discussed below can be adjusted based on vehicle speed and/or location.

The steering wheel angle cycle occurs when the steering wheel is turned in a first angular direction (e.g., clockwise) relative to a zero or center position, and then turned in a second opposite angular direction (e.g., counter-clockwise) relative to the zero position. A threshold steering angle is selected for both directions, which may be selected based on steering angles associated with applying some threshold amount of force on the cables that can cause the cable to stretch. For example, a first threshold steering angle is selected that establishes a threshold angle in the first direction relative to the zero position, and a second threshold steering angle is selected that establishes a threshold angle in the second directions. The thresholds may be the same (i.e., representing the same angle in both directions relative to the zero position) or may be different.

The following angle cycle occurs when the steering wheel is turned in the first direction by a selected threshold amount (a selected angular distance from the zero position) to an angular position, and then turned in the second direction from the angular position by at least the threshold amount.

The torque cycle occurs when the steering wheel torque (the amount of torque applied by the steering wheel) in the first direction meets or exceeds a first torque threshold, and then steering wheel torque is applied in the second direction by an amount of torque that meets or exceeds a second torque threshold. The torque thresholds may be based on amounts of torque associated with excessive cable stretching or otherwise associated with cable wear.

FIG. 4 shows an example of the method 60, which includes a number of steps or stages represented by blocks 61-79. All of the stages may be performed in the order described below, however the order of the stages may be changed. In addition, all of the stages may be performed, or less than all can be performed. For example, the method 60 can be configured so that only one or two of the cycles are counted and used in the method. In this example, the thresholds are referred to as upper and lower thresholds, where the upper threshold is associated with a first direction (e.g., clockwise) and the lower threshold is associated with a second direction (e.g., counter-clockwise). However, designations of upper and lower can be reversed.

The method 60 includes monitoring the steering wheel angle (i.e., angular position relative to the zero position) and the amount of torque supplied via the steering wheel by a processor such as the controller 48. At block 61, the processor detects whether the steering wheel angle meets or exceeds an upper fixed angle threshold in the first direction. If the angle meets or exceeds the upper threshold, an indicator such as a fixed upper threshold flag is set to a selected value (e.g., true) at block 62. The processor then detects whether the steering wheel is turned in the second direction and meets or exceeds a lower fixed angle threshold (block 63), and increments a steering cycle counter at block 64 if the lower threshold is met. At block 65, the upper threshold flag is re-set (e.g., to false) and the processor continues to monitor the steering angle. The steering cycle counter records the number of times the steering wheel angle goes above the upper threshold and back below the lower threshold in relation to the zero position (i.e., a steering wheel angle cycle is detected).

At block 66, the processor detects whether torque in the first direction exceeds an upper torque threshold. If the torque exceeds the upper threshold, an indicator such as a torque upper threshold flag is set (e.g., to true) at block 67.

The processor then detects whether the torque in the second direction exceeds the lower threshold (block 68), and if the torque in the second direction exceeds the lower threshold, a torque cycle counter is incremented (block 69). At block 70, the upper torque threshold flag is re-set (e.g., to false) and the processor continues to monitor the steering angle. The torque cycle counter records the number of times the steering wheel torque goes above a threshold and back below a lower threshold (i.e., a torque cycle is detected).

The processor may also monitor the steering system to detect a "following angle" cycle, in which the steering angle exceeds a calibratable threshold (referred to as a following angle threshold), changes direction, and turns in the opposite direction by an amount equal to or greater than the threshold amount. At block 71, the processor monitors the steering wheel angle to detect when the steering angle exceeds a following angle threshold in the first direction. If the steering angle in the first direction exceeds the threshold, the processor then detects at block 72 whether the steering wheel changes direction and turns from the position detected at block 71 by at least the following angle threshold. If so, a following angle cycle counter is incremented (block 73).

In one embodiment, if any of the counters exceed an associated counter threshold, the processor is configured to notify an operator. The notification can take any suitable form such as a visual notification (e.g., a light, a graphic display or a textual display), an audible notification (e.g., a beep or tone) or a touch notification.

For example, as shown in FIG. 4, the processor can provide haptic feedback to notify the operator that one or more cycle counters have reached or exceeded an associated threshold. For example, the counters are monitored at blocks 74-76, and if a counter exceeds an associated threshold number, haptic feedback or other suitable notification may be generated (blocks 77-79). The haptic feedback can be a vibration that is tailored to each type of counter. For example, each counter can be associated with a different duration of vibration and/or series of intermittent vibrations. The haptic feedback can be configured to notify the operator when individual thresholds have been exceeded and/or when multiple thresholds or all thresholds have been exceeded.

In addition to wear and stretching due to repeated steering cycles, the cable stretches each time the steering wheel is turned to an end of stroke or end stop position. A marine steering system can be configured to set end stop or end of travel (EOT) positions in both (opposite) directions relative to the zero position. When the steering wheel approaches and/or achieves an EOT position, the steering system can reduce torque assist (or generate opposite torque) to make steering harder or prevent the steering wheel from being turned further. When the steering system is coupled with a marine cable driven system and steered to EOT, the cable will stretch. This causes undue stress on the cable system and could result in cable failure.

To mitigate this, the system can implement an algorithm that determines EOT positions and is configured to reduce or remove torque assist when the steering wheel reaches an EOT position and/or when the steering wheel approaches the EOT system. As the cable wears and is stretched over time, the EOT positions may be re-calibrated.

Figure 5:
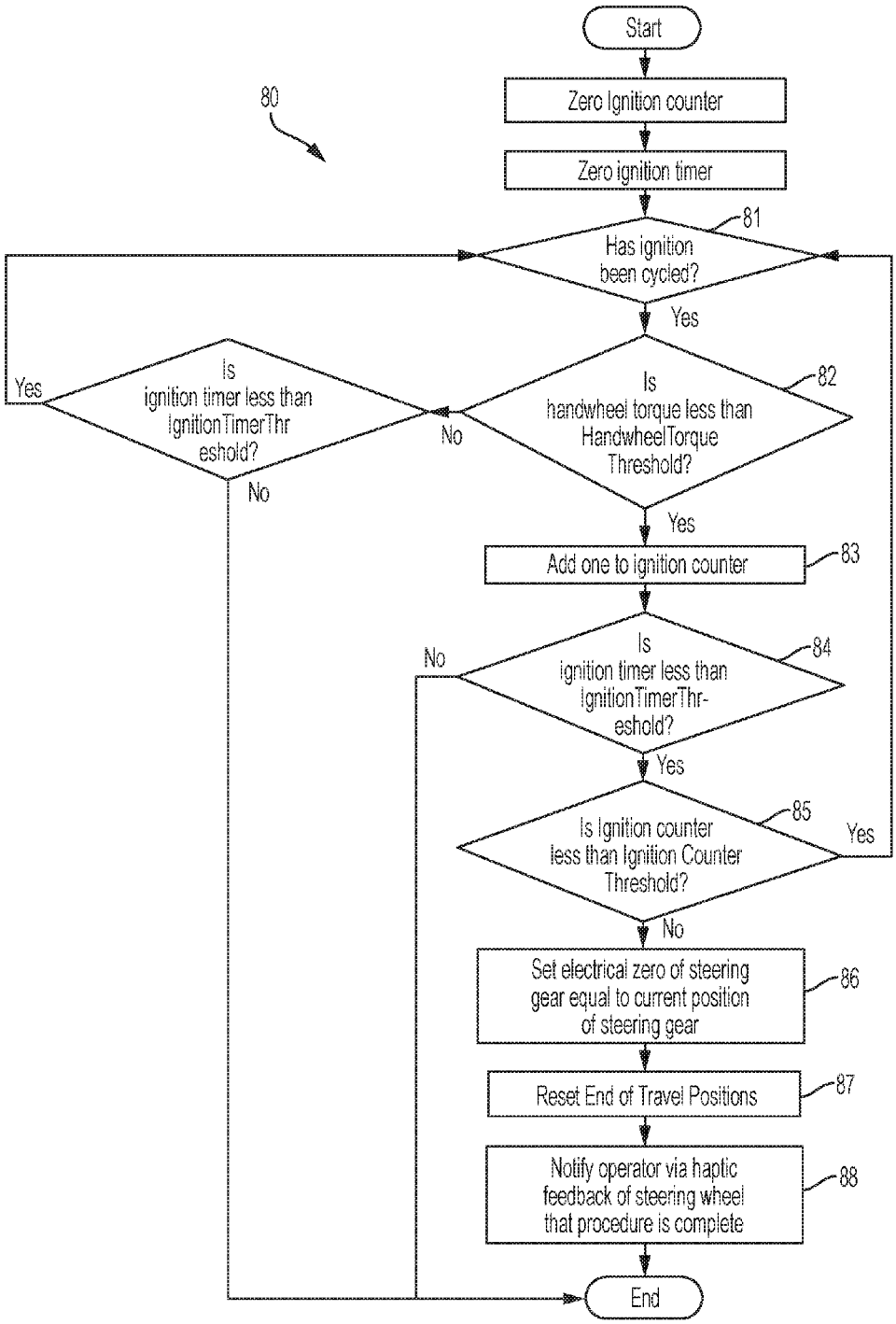
FIG. 5 is a flow diagram illustrating aspects of a method of controlling steering of a marine vessel, which includes monitoring steering system cycles and determining when EOT positions should be adjusted or recalibrated.

FIG. 5 illustrates an embodiment of a method 80 of monitoring steering system cycles and determining when EOT positions should be adjusted or recalibrated, and setting or calibrating EOT positions. The method includes looking for a calibratable number of key cycles within an adjustable amount of time, which causes a control system to start EOT adjustment or calibration. The calibratable number may be selected on wear characteristics of the cable, such as knowledge of how the cable stretches or deforms over time. Once the algorithm is started, it sets the electrical zero of the steering system to the current location of the steering system. The EOT positions are then reset such that the system will begin calculating or learning new EOT positions. This is able to be done without any external tools or equipment, so that an end user can service the steering system.

The method 80 includes a number of steps or stages represented by blocks 81-79. All of the stages may be performed in the order described below, however the order of the stages may be changed. In addition, all of the stages may be performed, or less than all can be performed.

At block 81, the processor detects when the vessel is started, i.e., when ignition is started, e.g., by a key turned by the operator. The processor then detects whether and how much torque is applied to the steering wheel, and determines whether the torque is less than a selected torque threshold (block 82). The torque threshold may be selected to be an amount typically experienced when the operator is not applying torque to the steering wheel (e.g., a hands off condition).

If the steering wheel torque is less than the threshold, the processor actuates an ignition counter to track the number of key cycles (block 83). If an ignition timer is less than a selected threshold (block 84), and the ignition counter indicates that the number of key cycles meets or exceeds a threshold number (block 85), the processor automatically re-calibrates the EOT positions.

At block 86, the processor sets the zero position of the steering system (e.g., sets the current position of the steering wheel to the zero position). At block 87, the processor then sets new EOT positions (clockwise and counter-clockwise) based on the new zero position. For example, the processor performs an initial lock-to-lock steer and measures steering wheel torque to establish new EOT positions, and/or learns the EOT positions during operation of the vessel or during a service state of the system.

In one embodiment, the processor can notify an operator when a counter number threshold has been reached, when re-calibration is to be performed, and/or when re-calibration is complete. For example, at block 88, the processor notifies the operator via haptic feedback or other suitable mechanism, when re-calibration is commenced and/or completed.

Embodiments described herein provide various advantages. For example, the steering assist unit provides power assist to an operator and/or prevents the operator for over-rotating the steering wheel.

In addition, the steering assist unit may be the only component of the vessel steering system that is electrically powered. In the event of loss of electrical power, the mechanical steering system would remain operational.

The steering assist unit provides steering assist to an operator, allowing for use of mechanical cable steering systems in vessels that conventionally require more expensive hydraulic steering. For example, conventional cable steering systems are restricted to lower power (e.g., less than 150 horsepower) vessels, as conventional cable steering systems in higher power vessels would not allow an operator to comfortably steer the vessel. The embodiments described herein allow for the use of less expensive cable steering systems in higher power and larger vessels.

In addition, the steering assist unit described herein can be readily installed as original manufacturer equipment or subsequently installed without requiring reconfiguration of the current steering and propulsion systems.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A system for controlling a marine vessel comprising:

an electrical power steering unit coupled to a mechanical control system, the mechanical control system including a steering wheel connected by a shaft to a mechanical cable assembly, the mechanical cable assembly including a steering cable and configured to be actuated by the steering wheel to control a steering mechanism of the marine vessel, the electrical power steering unit including an electric motor configured to apply a torque to the mechanical cable assembly; and a processor configured to control the electrical power steering unit to provide at least one of steering assist and control of the marine vessel, wherein the processor is configured to control the motor to apply an amount of torque to the steering mechanism based on selected end of travel positions, and the processor is configured to re-calibrate the selected end of travel positions based on a number of key cycles being equal to or greater than a threshold number.

2. The system of claim 1, wherein the electrical power steering unit is a column electrical power steering (CEPS) unit.

3. The system of claim 1, wherein the electrical power steering unit is disposed within a marine steering column mounting area, and disposed between the steering wheel and a connection to the mechanical cable.

4. The system of claim 1, wherein the electrical power steering unit includes a mechanical gear assembly having an input adapter configured to engage the shaft connected to the steering wheel.

5. The system of claim 1, wherein the processor is configured to monitor a steering wheel angle and a steering wheel torque, and detect at least one of:

a number of steering wheel angle cycles, wherein each steering wheel angle cycle is detected based on the steering wheel being positioned to a first steering wheel angle in a first direction relative to a zero position, followed by the steering wheel being positioned to a second steering wheel angle in a second direction relative to the zero position, the second direction opposite to the first direction, the first steering wheel angle and the second steering wheel angle being equal to or greater than a respective threshold angle;

a number of torque cycles, wherein each torque cycle is detected based on a steering wheel torque being applied in the first direction, followed by the steering wheel torque being applied in the second direction, the steering wheel torque in the first direction being equal to or greater than a first torque threshold, the steering wheel torque in the second direction being equal to or greater than a second torque threshold; and a number of following angle cycles, wherein each following angle cycle is detected based on the steering wheel being turned in the first direction by at least a threshold amount to an angular position, followed by the steering wheel being turned in the second direction from the angular position by at least the threshold amount.

6. The system of claim 5, wherein the processor is configured to notify an operator based on at least one of the number of steering wheel cycles, the number of torque cycles and the number of following angle cycles exceeding one or more respective threshold numbers indicative of cable wear.

7. The system of claim 1, the threshold number selected based on wear characteristics of the cable.

8. The system of claim 1, wherein the processor is configured to receive rotational position information from a torque and/or position sensor, and autonomously generate a motor torque command to the motor to apply a selected amount of torque to return the steering wheel to a center position.

9. The system of claim 6, wherein the processor is configured to generate the motor torque command to apply torque based on the rotational position of the steering wheel relative to a mechanical end stop.

10. The system of claim 1, wherein the processor is configured to generate a motor torque command to the motor to apply a selected amount of torque to assist an operator, the selected amount of torque based on a speed of the marine vessel.

11. A method of controlling a marine vessel, the method comprising:

receiving sensor data from a sensor at a processor, the sensor data including at least one of a rotational position of a steering wheel and a torque applied by the steering wheel, the steering wheel connected by a shaft to a mechanical cable assembly, the mechanical cable assembly including a steering cable and configured to be actuated by the steering wheel to control a steering mechanism of the marine vessel;

generating a motor torque command to an electrical power steering unit coupled to at least the mechanical cable, the electrical power steering unit including an electric motor configured to apply a torque to the mechanical cable assembly;

providing at least one of steering assist and control of the marine vessel by the electric motor in response to the motor torque command; and controlling the motor to apply an amount of torque to the steering mechanism based on selected end of travel positions, and re-calibrating the selected end of travel positions based on a number of key cycles being equal to or greater than a threshold number.

12. The method of claim 11, wherein the electrical power steering unit is a column electrical power steering (CEPS) unit.

13. The method of claim 11, wherein the electrical power steering unit is disposed within a marine steering column mounting area, and disposed between the steering wheel and a connection to the mechanical cable.

14. The method of claim 11, wherein the electrical power steering unit includes a mechanical gear assembly having an input adapter configured to engage the shaft connected to the steering wheel.

15. The method of claim 11, further comprising monitoring a steering wheel angle and a steering wheel torque, and detecting at least one of:

a number of steering wheel angle cycles, wherein each steering wheel angle cycle is detected based on the steering wheel being positioned to a first steering wheel angle in a first direction relative to a zero position, followed by the steering wheel being positioned to a second steering wheel angle in a second direction relative to the zero position, the second direction opposite to the first direction, the first steering wheel angle and the second steering wheel angle being equal to or greater than a respective threshold angle;

a number of torque cycles, wherein each torque cycle is detected based on a steering wheel torque being applied in the first direction, followed by the steering wheel torque being applied in the second direction, the steering wheel torque in the first direction being equal to or greater than a first torque threshold, the steering wheel torque in the second direction being equal to or greater than a second torque threshold; and a number of following angle cycles, wherein each following angle cycle is detected based on the steering wheel being turned in the first direction by at least a threshold amount to an angular position, followed by the steering wheel being turned in the second direction from the angular position by at least the threshold amount.

16. The method of claim 15, further comprising notifying an operator based on at least one of the number of steering wheel cycles, the number of torque cycles and the number of following angle cycles exceeding one or more respective threshold numbers indicative of cable wear.

17. The method of claim 11, the threshold number selected based on wear characteristics of the cable.

18. The method of claim 11, further comprising autonomously generating a motor torque command to the motor to apply a selected amount of torque to return the steering wheel to a center position.

19. The method of claim 11, wherein the motor torque command is based on a rotational position of the steering wheel relative to a mechanical end stop.

20. The method of claim 11, wherein the motor torque command directs the motor to apply a selected amount of torque to assist an operator, the selected amount of torque based on a speed of the marine vessel.

* * * * *